US008203523B2

(12) United States Patent
Han et al.

(10) Patent No.: US 8,203,523 B2
(45) Date of Patent: Jun. 19, 2012

(54) METHOD AND APPARATUS FOR SELECTIVELY APPLYING INPUT GAMMA DITHERING

(75) Inventors: Seok-Jin Han, Cupertino, CA (US); Sarah Sunyoung Hwang, Sunnyvale, CA (US)

(73) Assignee: Samsung Electronics Co., Ltd. (KR)

( * ) Notice: Subject to any disclaimer, the term of this patent is extended or adjusted under 35 U.S.C. 154(b) by 518 days.

(21) Appl. No.: 12/511,823

(22) Filed: Jul. 29, 2009

(65) Prior Publication Data

US 2011/0025591 A1 Feb. 3, 2011

(51) Int. Cl.
*G09G 3/36* (2006.01)

(52) U.S. Cl. ..... 345/102; 345/589; 345/596; 345/690; 345/204; 345/84; 348/254; 348/674; 362/97.1

(58) Field of Classification Search ..... 345/102, 345/207, 581, 589, 596, 600, 605, 690, 82–84, 345/76–77, 204; 348/254, 674; 349/69–70; 362/97.1–97.3
See application file for complete search history.

(56) References Cited

U.S. PATENT DOCUMENTS

2008/0074372 A1* 3/2008 Baba et al. ..... 345/89
2008/0084432 A1* 4/2008 Jeon ..... 345/690

* cited by examiner

*Primary Examiner* — Lun-Yi Lao
*Assistant Examiner* — Md Saiful A Siddiqui
(74) *Attorney, Agent, or Firm* — Innovation Counsel LLP

(57) ABSTRACT

Display systems that employ input gamma dithering and dynamic backlight control. Embodiments relate to disabling input gamma dithering during periods when there is a change in the scale value by which image data is scaled due to dynamic backlight control. In this manner, input gamma dithering is selectively applied only during those times when data scaling due to dynamic backlight control is constant.

22 Claims, 2 Drawing Sheets

METHOD AND APPARATUS FOR SELECTIVELY APPLYING INPUT GAMMA DITHERING

BRIEF DESCRIPTION

This invention relates generally to image processing. More specifically, this invention relates to the selective application of input gamma dithering.

BACKGROUND

Current flat panel displays, such as liquid crystal displays (LCDs), often utilize an image processing system that processes RGB image data for display on the LCD. The input RGB data is typically gamma corrected, and its bit depth is increased, whereupon various processing is performed on the data as desired. Such processing can include conversion to other desired color systems such as RGBW, scaling, and subpixel rendering. After this processing, the bit depth is usually reduced or restored to that of the original input RGB data, and displayed on the LCD. While the general parameters of this processing are known, continuing efforts are made to streamline and enhance this processing, so as to improve the quality of the resulting displayed images and the efficiency by which they are generated.

SUMMARY

Embodiments of the invention can be implemented in a number of ways, including as a method and as a system.

In one embodiment, a method of processing image data comprises receiving a first frame of image data, and determining a first scale value corresponding to a first illumination of a backlight, the first scale value determined at least partially according to the first frame of image data. The method also includes receiving a second frame of image data, and determining a second scale value corresponding to a second illumination of the backlight, the second scale value determined at least partially according to the second frame of image data. Input gamma dithering of a third frame of image data is enabled when the first scale value is substantially the same as the second scale value. Input gamma dithering of the third frame of image data is disabled when the first scale value is not substantially the same as the second scale value.

In another embodiment, a method of processing image data comprises, in a system processing image data and controlling a corresponding illumination of a backlight, enabling input gamma dithering of the image data when the corresponding illumination does not change temporally, and disabling input gamma dithering when the corresponding illumination changes temporally.

In a further embodiment, a computer-readable memory stores instructions for carrying out a method of processing image data. The method comprises, in a system processing image data and controlling a corresponding illumination of a backlight, enabling input gamma dithering of the image data when the corresponding illumination does not change temporally, and disabling input gamma dithering when the corresponding illumination changes temporally.

In a still further embodiment, a system for processing image data comprises an input gamma block receiving first image data having a first bit depth, and converting the first image data to second image data having a second bit depth. The system also includes a dithering block receiving the second image data and performing a dithering operation on the second image data so as to generate third image data having a third bit depth, as well as a backlight control block controlling an output of a backlight and generating a backlight change signal indicating a change in the output of the backlight. Also included is logic receiving the backlight change signal and instructing the dithering block to disable the dithering operation when the backlight change signal indicates the change in the output of the backlight.

Other aspects and advantages of the invention will become apparent from the following detailed description taken in conjunction with the accompanying drawings which illustrate, by way of example, the principles of the invention.

BRIEF DESCRIPTION OF THE DRAWINGS

For a better understanding of the invention, reference should be made to the following detailed description taken in conjunction with the accompanying drawings, in which.

Like reference numerals refer to corresponding parts throughout the drawings.

DETAILED DESCRIPTION

In one embodiment, the invention relates to display systems that employ input gamma dithering and dynamic backlight control. More specifically, embodiments relate to disabling input gamma dithering during periods when there is a change in the scale value by which image data is scaled due to dynamic backlight control. In this manner, input gamma dithering is selectively applied only during those times when data scaling due to dynamic backlight control is constant.

It has been found that, when input gamma dithering is employed concurrent with data scaling due to dynamic backlight control, the two processes sometimes interact to produce undesired visual effects in the displayed image. In particular, when input gamma dithering was applied to two successively-displayed images each having different scale values, undesired visible luminance fluctuations were sometimes seen. Accordingly, embodiments of the invention determine when changes in backlight are to occur (i.e., when changes in data scale value occur), and disable input gamma dithering during those times.

As used herein, "dynamic backlight control" refers to any modulation or changing of backlight illumination according to the image displayed, so as to improve image quality. That is, dynamic backlight control modulates the intensity of backlight illumination according to the particular image displayed, so that backlight intensity changes over time or temporally, potentially changing with each new frame of image data. This is often accompanied by a change in one or more data "scale values" used to scale image data so as to visually compensate for changes in backlight intensity. Furthermore, "input gamma dithering" refers to any process by which gamma-corrected data is adjusted so as to compensate for reduction in its bit depth. Explanation of one exemplary input gamma dithering process is given below. Further details of embodiments of input gamma dithering are also presented in U.S. patent application Ser. No. 12/123,417, filed on May 19, 2008, which is hereby incorporated by reference in its entirety.

Figure 1:
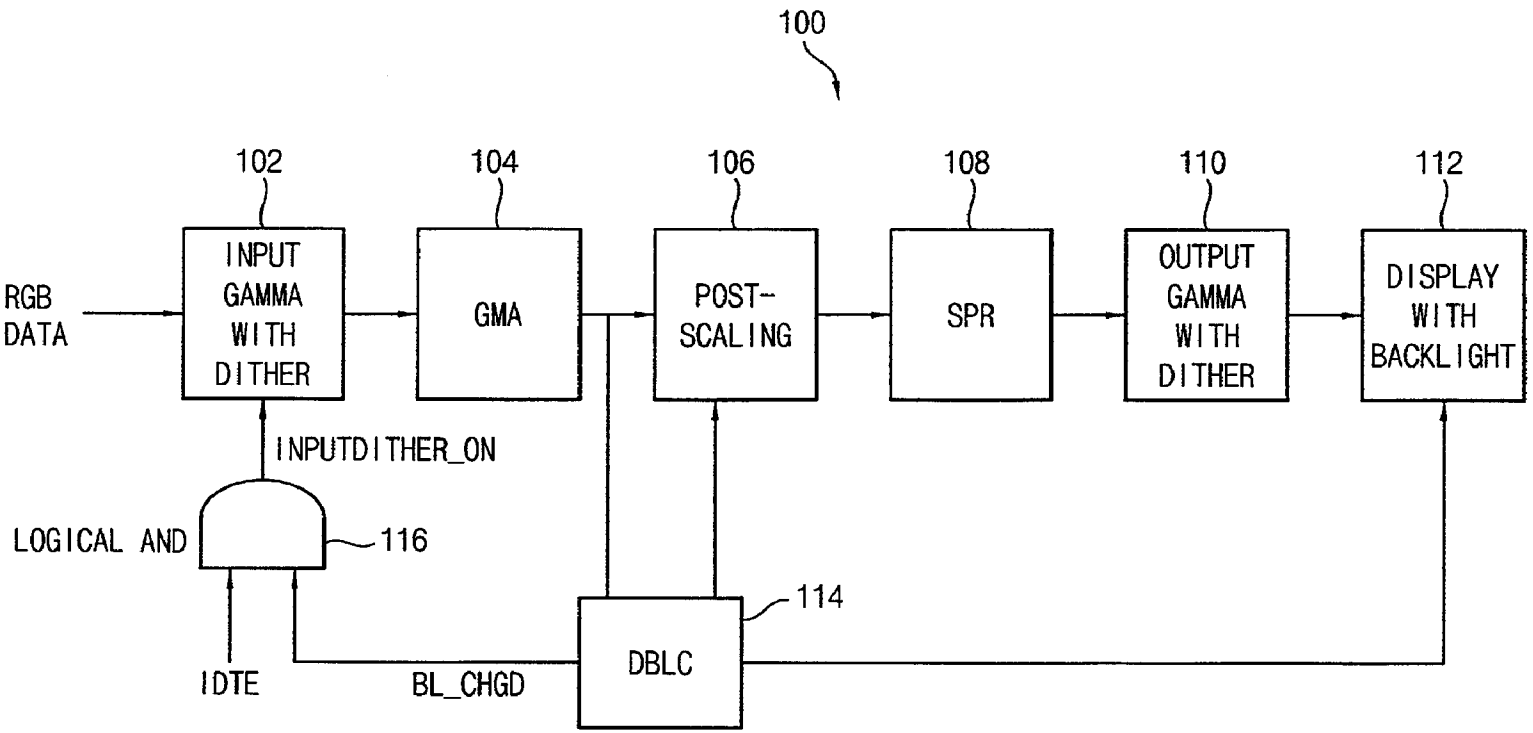
FIG. 1 is a block diagram representation of a display system in accordance with embodiments of the present invention.

FIG. 1 is a block diagram representation of a display system in accordance with embodiments of the present invention. Display system 100 can be any display having an image processing pipeline as shown, such as an LCD or other flat-panel type display. Image data such as RGB data is sent to input gamma and dither block 102, where it is gamma corrected and its bit depth is increased. Dithering is often performed as part of this increase. The resulting data is sent to gamut mapping algorithm (GMA) block 104 for conversion, if desired, to RGBW or any other suitable format. Post-scaling block 106 scales the RGBW data according to inputs including a scale value received from dynamic backlight control block (DBLC) 114, so as to bring any out-of-gamut data back into gamut. Subpixel rendering (SPR) block 108 performs subpixel rendering on the gamut-corrected RGBW data to increase its resolution, whereupon output gamma and dither block 110 converts the data back to the bit depth of the initial RGB data and/or applies another gamma correction to correct for the native gamma of the display 112. The resulting data is then displayed on display and backlight unit 112.

Simultaneously, DBLC block 114 reads the RGBW (or other) format image data from GMA block 104, and determines an appropriate backlight illumination. As each frame of RGBW data can have a different backlight illumination, dynamic backlight control block 114 controls the backlight 112 so that its illumination varies with the displayed image, resulting in a time-varying backlight illumination. The DBLC block 114 also transmits a BL_CHGD signal to logical AND gate 116, when the backlight illumination changes. An input dither enable register bit IDTE is a user-set register bit indicating whether the user desires input gamma dithering to be set to on or off. Here, a user (or some program) can set IDTE to 1 if input gamma dithering is to be allowed, and 0 if input gamma dithering is to be turned off. The value of IDTE is also sent to the AND gate 116. AND gate 116 performs a logical AND operation on the BL_CHGD and IDTE signals, and sends the resulting InputDither_ON signal to input gamma and dither block 102, directing the input gamma and dither block 102 to disable dithering when the backlight illumination changes, and to enable it at all other times.

In the operation of one embodiment of display system 100, frames of RGB image data are received at the input gamma and dither block 102, where each undergoes gamma correction and has its bit depth increased. In one embodiment, the input gamma and dither block 102 receives frames of image data in the form of 8-bit R, G, and B data, performs gamma correction, and converts the bytes of each frame to 12-bit R, G, and B data segments. To reduce gate count but still retain a desirable degree of accuracy, these 12-bit data segments are dithered down to 11-bit segments of data, as further explained below.

Many applications desire RGBW displays rather than RGB displays. For such applications, the resultant data frames (made up of 11-bit data segments) are sent to GMA block 104 for conversion to 11-bit RGBW format. The output of GMA block 104 is then sent to both post-scaling block 106 and DBLC block 114. As above, the post-scaling block 106 scales the 11-bit RGBW data according to inputs including scale values from DBLC block 114 so as to bring each pixel back into gamut, while the SPR block 108 performs subpixel rendering, breaking the RGBW data into 11-bit RG and BW subpixels and correcting the colors appropriately. The subpixel rendered data is then truncated down to 8-bit data to match the original RGB input frames and gamma-corrected to compensate for any native gamma of the display 112, whereupon the frames are sent to the display to generate an image.

The DBLC block 114 also receives the output of GMA block 104 and, for each frame of RGBW image data, calculates a corresponding backlight illumination. The DBLC block 114 typically scales down the illumination of backlight 112 depending on the image, so as to save power. However, in order to maintain image quality, the image's brightness should be scaled up to compensate for this reduction in backlight illumination. Accordingly, the DBLC block 114 also sends a scale value to post-scaling block 106, so that block 106 can multiply that frame's data values by this scale value. In short, for each frame of image data, the DBLC block 114 determines an appropriate backlight illumination value and sends that value to display 112, and also determines a corresponding scale value by which the frame's data values should be multiplied to compensate for any change in backlight illumination. This scale value is sent to post-scaling block 106, which multiplies the image data by that scale value. Calculation and use of such scale values is known, and the invention contemplates use of any scale values, determined in any manner. Exemplary schemes for carrying out dynamic backlight control, including the determination and use of such scale values, can be found in U.S. patent application Ser. No. 11/750,895 filed on May 18, 2007; Ser. No. 12/303,102 filed on May 14, 2007; Ser. No. 12/253,146 filed on Oct. 16, 2008; as well as Ser. Nos. 12/123,414, 12/123,415, and 12/123,417, each filed on May 19, 2008; each of which is hereby incorporated by reference in its entirety.

As described above, undesired visual effects can occur when input gamma dithering is applied to two successive frames whose scale values differ. That is, problems can arise when both input gamma dithering and changing scale values are present. As above, these changes in scale values arise concurrently with changes in backlight illumination. Thus, changes in backlight illumination can serve as both an indicator of when these undesired visual effects may arise, and can indicate when to reduce or eliminate these effects by either disabling dithering or holding scale values constant. Accordingly, the display system 100 disables input gamma dithering when the DBLC block 114 indicates that backlight intensity is changing from one frame to the next.

The DBLC block 114 accomplishes this by sending the BL_CHGD signal to AND gate 116, where BL_CHGD is asserted low when DBLC block 114 determines that backlight illumination is to change from the frame that has just been processed to the frame currently being processed (i.e., when input gamma dithering should be disabled), and BL_CHGD is asserted high otherwise (i.e., when dithering should be applied for that frame).

The AND gate 116 also receives register-based control bit IDTE, which is set to 1 when input gamma dithering is enabled and 0 otherwise. Thus, when IDTE=1 and BL_CHGD is asserted high, input gamma dithering is enabled and should remain so—AND gate 116 thus sets InputDither_ON to 1, which instructs input gamma and dither block 102 to continue its dithering operations. If IDTE=1 and BL_CHGD is asserted low, input gamma dithering is enabled but should be disabled. InputDither_ON is thus set to 0, disabling dithering. If IDTE=0, the user has already turned input gamma dithering off. The output of the AND gate 116 is irrelevant in this case, as dithering is already turned off. However, whether BL_CHGD is asserted high or low, the AND gate 116 would set InputDither_ON to 0.

In summary, an aspect of the invention involves determining whether a change in dynamic backlighting scale value occurs from one frame to the next and, if so, disabling input gamma dithering. However, it should be noted that the invention encompasses both the disabling of dithering for that very same "next" frame, and disabling dithering for a subsequent frame. That is, once it is determined that a first frame has a first scale value and the very next frame, i.e. a second frame, has a second scale value different from the first scale value, the invention encompasses embodiments for which dithering is disabled for that second frame, as well as embodiment which instead disable dithering for a third frame.

For example, in embodiments of the system 100 of FIG. 1, one of ordinary skill in the art would observe that the DBLC block 114 would need to process an entire frame in order to determine the proper scale value, and thus the BL_CHGD value, for that frame. That is, block 114 would not determine a frame's BL_CHGD value until it has processed the entire frame. By then, the input gamma and dither block 102 would already be processing the next frame of image data, and InputDither_ON would be applied to enable/disable dithering for that next frame, rather than the frame for which block 114 just processed. In such embodiments, system 100 would determine that the scale value has changed from a first frame to a second, and would enable/disable dithering for a third frame.

However, other embodiments would also determine that the scale value has changed from a first frame to a second, and enable/disable dithering for that second frame. Any appropriate hardware configuration is contemplated. As one example, the image processing pipeline can include two parallel pipelines of blocks 102-104, that produce gamma-corrected RGBW frames both with and without dithering. The AND gate 116 can then be connected to logic that selects which output of these two pipelines would be applied to post-scaling block 106, based on the value of InputDither_ON.

It should also be noted that the above description of FIG. 1 is merely exemplary, and that the invention encompasses other systems and methods as well. For example, while the above description enables or disables dithering for entire frames, the invention encompasses embodiments in which backlight illumination can vary for different portions of an image frame, and dithering is selectively enabled for only those portions of frames for which backlight illumination varies. Furthermore, the invention encompasses embodiments in which dithering is applied to certain pixels or portions of an image, rather than the entire image. Additionally, while input gamma and dither block 102 is described as a single block performing both gamma correction and dithering, the invention encompasses systems having separate blocks for gamma correction and dithering.

Figure 2:
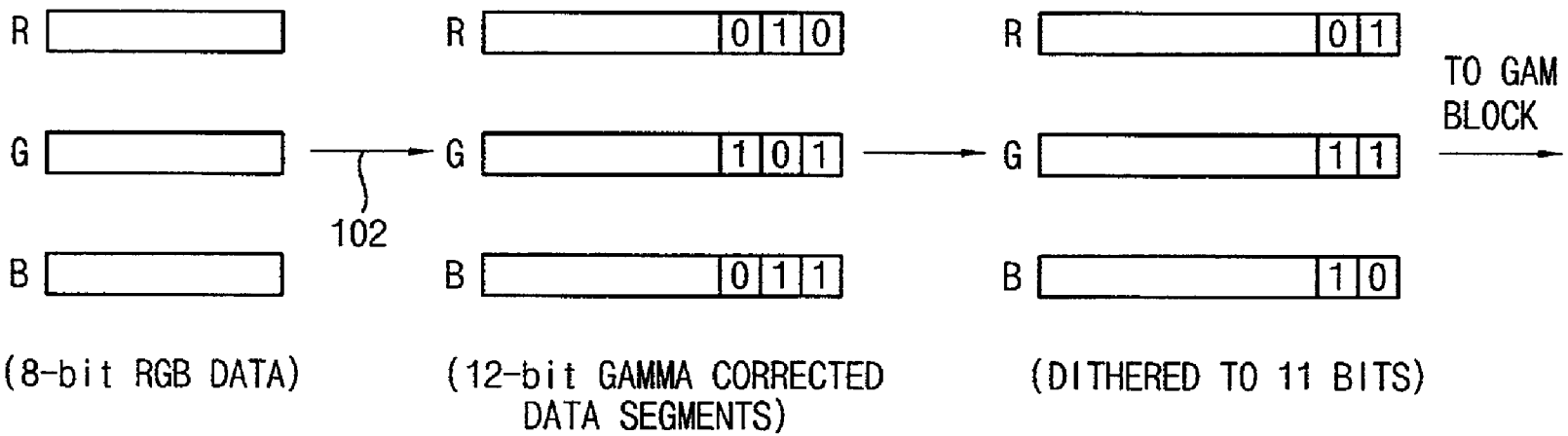
FIG. 2 illustrates further details of processing carried out by the input gamma and dithering block(s) of FIG. 1.

Attention now turns to a further explanation of input gamma dithering. While the invention encompasses any form of dithering used to reduce bit density of an image, one particular example is illustrated in connection with FIG. 2. FIG. 2 illustrates further details of processing carried out by the input gamma and dithering block(s) 102 of FIG. 1. As mentioned previously, RGB data is input to block 102 as three 8-bit data streams, corresponding to the red, green, and blue values for each pixel of an image. These bytes are represented on the left hand side of FIG. 2. The input gamma and dithering block 102 gamma-corrects this data, and also increases its bit depth to 12 bits, as shown. To reduce the amount of processing required (and thus to reduce gate count), this 12-bit data is reduced in bit depth to 11-bit data. This is accomplished by truncating the least significant bit of each 12-bit segment of data.

As above, dithering may or may not be desired for every segment of a frame. For those segments that are to have dithering applied, if the truncated bit is a 0, no change is made to the remaining 11 bits. However, if the truncated bit is a 1, a binary 1 is added to the remaining 11 bit data segment—that is, a 1 is added to what is, after truncation, the least significant bit.

FIG. 2 illustrates this process in greater detail, with the 12-bit R, G, and B data segments in the middle column of FIG. 2 truncated to yield the 11-bit R, G, and B data segments shown in the right hand column. Furthermore, the 11-bit segment of R data is kept unchanged after truncation, as its truncated $12^{th}$ bit had a value of binary 0. However, binary 1 was added to the 11-bit segments of G and B after truncation. Once this dithering operation is completed, the 11-bit dithered data is sent to the GMA block 104 for further processing as above.

Further details of input gamma dithering are also described in the previously incorporated application Ser. No. 12/123,417. As noted above, the invention contemplates any method of input gamma dithering, whether by the above-described method or another.

The foregoing description, for purposes of explanation, used specific nomenclature to provide a thorough understanding of the invention. However, it will be apparent to one skilled in the art that the specific details are not required in order to practice the invention. Thus, the foregoing descriptions of specific embodiments of the present invention are presented for purposes of illustration and description. They are not intended to be exhaustive or to limit the invention to the precise forms disclosed. Many modifications and variations are possible in view of the above teachings. For example, various embodiments of the invention contemplate any form of input gamma dithering. Furthermore, the methods of the invention can be applied to any suitable display, such as an LCD display, an LED display, or any other. The embodiments were chosen and described in order to best explain the principles of the invention and its practical applications, to thereby enable others skilled in the art to best utilize the invention and various embodiments with various modifications as are suited to the particular use contemplated.

What is claimed is:

1. A method of processing image data, comprising:

receiving a first frame of image data;

determining a first scale value corresponding to a first illumination of a backlight, the first scale value determined at least partially according to the first frame of image data;

receiving a second frame of image data;

determining a second scale value corresponding to a second illumination of the backlight, the second scale value determined at least partially according to the second frame of image data;

enabling input gamma dithering of a third frame of image data when the first scale value is substantially the same as the second scale value; and disabling input gamma dithering of the third frame of image data when the first scale value is not substantially the same as the second scale value.

2. The method of claim 1, wherein the backlight is a backlight of a liquid crystal display (LCD), and wherein the method further comprises:

displaying images on the LCD according to the first and second frames of image data; and illuminating the backlight of the LCD according to the first and second illumination when the displayed images corresponding to the first and second frames are respectively displayed on the LCD.

3. The method of claim 1:

wherein the method further comprises receiving the image data, the image data being first image data having a first bit depth, and increasing the bit depth of the received image data to a second bit depth greater than the first bit depth, so as to form second image data; and wherein the input gamma dithering further comprises reducing the bit depth of the second image data by:

for segments of the second image data having least significant bits with a value of binary 0, truncating the segments of the second image data so as to discard the least significant bits; and for segments of the second image data having least significant bits with a value of binary 1, truncating the segments of the second image data so as to discard the least significant bits, and adding binary 1 to the truncated segments of the second image data.

4. The method of claim 3, wherein the first bit depth is 8 bits, the second bit depth is 12 bits.

5. The method of claim 1, wherein the first illumination is an illumination of at least a portion of the backlight, and the second illumination is an illumination of at least a portion of the backlight.

6. The method of claim 5, wherein the input gamma dithering is a dithering performed on at least a portion of the second frame of image data.

7. A method of processing image data, comprising:

in a system processing image data and controlling a corresponding illumination of a backlight, enabling input gamma dithering of the image data when the corresponding illumination does not change temporally; and disabling input gamma dithering when the corresponding illumination changes temporally.

8. The method of claim 7, wherein the backlight is a backlight of a liquid crystal display (LCD), and wherein the method further comprises:

displaying images on the LCD according to the processed image data; and illuminating the backlight of the LCD according to the corresponding illumination when the processed image data is displayed on the LCD.

9. The method of claim 7, wherein:

when the corresponding illumination does not substantially change from a first frame of image data to a second frame of image data, the enabling further comprises enabling input gamma dithering of a third frame of image data; and when the corresponding illumination substantially changes from the first frame of image data to the second frame of image data, the disabling further comprises disabling input gamma dithering of the third frame of image data.

10. The method of claim 7, wherein:

enabling further comprises enabling input gamma dithering when a scale value for gamut correcting the image data according to the corresponding illumination does not change temporally; and the disabling further comprises disabling input gamma dithering when the scale value changes temporally.

11. The method of claim 7:

wherein the method further comprises receiving the image data, the image data being first image data having a first bit depth, and increasing the bit depth of the received image data to a second bit depth greater than the first bit depth, so as to form second image data; and wherein the input gamma dithering further comprises reducing the bit depth of the second image data by:

for segments of the second image data having least significant bits with a value of binary 0, truncating the segments of the second image data so as to discard the least significant bits; and for segments of the second image data having least significant bits with a value of binary 1, truncating the segments of the second image data so as to discard the least significant bits, and adding binary 1 to the truncated segments of the second image data.

12. The method of claim 11, wherein the first bit depth is 8 bits, and the second bit depth is 12 bits.

13. A non-transitory computer-readable memory storing instructions for carrying out a method of processing image data, the method comprising: in a system processing image data and controlling a corresponding illumination of a backlight, enabling input gamma dithering of the image data when the corresponding illumination does not change temporally; and disabling input gamma dithering when the corresponding illumination changes temporally.

14. The non-transitory computer-readable memory of claim 13, wherein: when the corresponding illumination does not substantially change from a first frame of image data to a second frame of image data, the enabling further comprises enabling input gamma dithering of a third frame of image data; and when the corresponding illumination substantially changes from the first frame of image data to the second frame of image data, the disabling further comprises disabling input gamma dithering of the third frame of image data.

15. The non-transitory computer-readable memory of claim 13, wherein: the enabling further comprises enabling input gamma dithering when a scale value for gamut correcting the image data according to the corresponding illumination does not change temporally; and the disabling further comprises disabling input gamma dithering when the scale value changes temporally.

16. The non-transitory computer-readable memory of claim 13: wherein the method further comprises receiving the image data, the image data being first image data having a first bit depth, and increasing the bit depth of the received image data to a second bit depth greater than the first bit depth, so as to form second image data; and wherein the input gamma dithering further comprises reducing the bit depth of the second image data by: for segments of the second image data having least significant bits with a value of binary 0, truncating the segments of the second image data so as to discard the least significant bits; and for segments of the second image data having least significant bits with a value of binary 1, truncating the segments of the second image data so as to discard the least significant bits, and adding binary 1 to the truncated segments of the second image data.

17. The non-transitory computer-readable memory of claim 16, wherein the first bit depth is 8 bits, and the second bit depth is 12 bits.

18. A system for processing image data, comprising:

an input gamma block receiving first image data having a first bit depth, and converting the first image data to second image data having a second bit depth;

a dithering block receiving the second image data and performing a dithering operation on the second image data so as to generate third image data having a third bit depth;

a backlight control block controlling an output of a backlight and generating a backlight change signal indicating a change in the output of the backlight; and logic receiving the backlight change signal and instructing the dithering block to disable the dithering operation when the backlight change signal indicates the change in the output of the backlight.

19. The system of claim 18, wherein the input gamma block is the dithering block.

20. The system of claim 18, wherein the logic further instructs the dithering block to enable the dithering operation when the backlight change signal indicates no change in the output of the backlight.

21. The system of claim 18, wherein the input gamma block is further configured to the bit depth of the second image data by:

for segments of the second image data having least significant bits with a value of binary 0, truncating the segments of the second image data so as to discard the least significant bits; and for segments of the second image data having least significant bits with a value of binary 1, truncating the segments of the second image data so as to discard the least significant bits, and adding binary 1 to the truncated segments of the second image data.

22. The system of claim 18, wherein the first bit depth is 8 bits, and the second bit depth is 12 bits.

* * * * *